US006795677B2

(12) United States Patent
Berkes et al.

(10) Patent No.: US 6,795,677 B2
(45) Date of Patent: Sep. 21, 2004

(54) HIGH SPEED HEAT AND PRESSURE BELT FUSER

(75) Inventors: John S. Berkes, Webster, NY (US); Anthony S. Condello, Webster, NY (US); Donald M. Bott, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/244,573

(22) Filed: Sep. 16, 2002

(65) Prior Publication Data

US 2004/0052555 A1 Mar. 18, 2004

(51) Int. Cl.[7] ..... G03G 15/20
(52) U.S. Cl. ..... 399/329; 219/216
(58) Field of Search ..... 399/328, 329, 399/320, 67; 219/216, 243, 388; 347/156

(56) References Cited

U.S. PATENT DOCUMENTS

| | | | | |
|---|---|---|---|---|
| 4,242,566 A | | 12/1980 | Scribner | 219/216 |
| 4,582,416 A | | 4/1986 | Karz et al. | 399/329 |
| 4,992,304 A | | 2/1991 | Titterington | 427/104 |
| 5,250,998 A | | 10/1993 | Ueda et al. | 399/329 |
| 5,349,424 A | | 9/1994 | Dalal et al. | 399/329 |
| 5,465,146 A | | 11/1995 | Higashi et al. | 399/328 |
| 5,729,812 A | | 3/1998 | Moser | 399/329 |
| 5,873,020 A | * | 2/1999 | Matsuura et al. | 399/329 |
| 5,890,047 A | | 3/1999 | Moser | 399/329 |
| 5,907,348 A | * | 5/1999 | Ogasawara et al. | 399/329 X |
| 5,983,048 A | | 11/1999 | Moser | 399/67 |
| 6,148,169 A | * | 11/2000 | Tsukamoto | 399/328 |
| 6,246,858 B1 | | 6/2001 | Condello et al. | 399/329 |

FOREIGN PATENT DOCUMENTS

JP 09-138597 * 5/1997

OTHER PUBLICATIONS

USSN 10/093,263, filed on Mar. 8, 2002, entitled "Externally Heated Thick Belt Fuser," by Anthony S. Condello, et al.

USSN 10/217,683, filed on Aug. 12, 2002, entitled "High Speed Heat and Pressure Belt Fuser," by John S. Berkes, et al.

* cited by examiner

*Primary Examiner*—Sophia S. Chen
(74) *Attorney, Agent, or Firm*—Benjamin Sklar

(57) ABSTRACT

A high speed heat and pressure belt fuser apparatus or structure for fixing toner images including an endless belt and a pair of pressure members between which the endless belt is sandwiched for forming a fusing nip through which substrates carrying toner images pass with the toner images contacting an outer surface of the endless belt. Efficient uniform heat transfer to a fusing belt, especially belts with macro non-uniformities and/or a rough surface, for enabling better toner fusing uniformity, preventing localized cold offset and extending belt life is effected by the addition of a spring loaded mechanism inside a belt module within the region of contact with the External Heat Roll (EHR). Such an arrangement produces superior contact and therefore better heat transfer to the belt. A positive and consistent heating contact is essential for uniform and high image gloss.

19 Claims, 5 Drawing Sheets

HIGH SPEED HEAT AND PRESSURE BELT FUSER

BACKGROUND

This invention relates generally to electrostatographic imaging, and more particularly, it relates to a high-speed heat and pressure belt fusing apparatus for fixing images to a final substrate.

In a typical electrophotographic copying or printing process, a charge retentive surface such as a photoconductive member is charged to a substantially uniform potential so as to sensitive the surface thereof. The charged portion of the photoconductive member is selectively exposed to light to dissipate the charges thereon in areas subjected to the light. This records an electrostatic latent image on the photoconductive member. After the electrostatic latent image is recorded on the photoconductive member, the latent image is developed by bringing one or more developer materials into contact therewith. Generally, the developer material comprises toner particles adhering triboelectrically to carrier granules. The toner particles are attracted from the carrier granules either to a donor roll or to a latent electrostatic image on the photoconductive member. When attracted to a donor roll the toner particles are subsequently deposited on the latent electrostatic images. The toner powder image is then transferred from the photoconductive member to a final substrate. The toner particles forming the toner powder images are then subjected to a combination of heat and/or pressure to permanently affix the powder images to the copy substrate.

In order to fix permanently or fuse the toner material onto a substrate or support member such as plain paper by heat, it is necessary to elevate the temperature of the toner material to a point at which constituents of the toner material coalesce and become tacky. This action causes the toner to flow to some extent onto the fibers and/or into the pores of the support member or otherwise upon the surface thereof. Thereafter, as the toner material cools, solidification of the toner material occurs causing the toner material to be bonded firmly to the support member.

One approach to thermal fusing of toner material images onto the final substrate has been to pass the substrate with the unfused toner images thereon between a pair of opposed roller members, at least one of which is internally heated. During operation of a fusing system of this type, the substrate to which the toner images are electrostatically adhered is moved through a nip formed between the pressure engaged rolls with the toner image contacting the heated fuser roll to thereby effect heating of the toner images within the nip. In a Nip Forming Fuser Roll (NFFR), the heated fuser roll is provided with a layer or layers that are deformable (i.e. conformable) by a harder pressure roll when the two rolls are pressure engaged. The length of the nip determines the dwell time or time that the toner particles remain in contact with the surface of the heated roll, the dwell time being also determinative of the fuser's speed.

The layer or layers usually comprise an abhesive (low surface energy) material for preventing toner offset to the fuser member. Three materials, which are commonly used for such purposes, are fluoropolymers, fluoroelastomers and silicone rubber.

Roll fusers work well for fusing color images at lower speeds since the required process conditions such as temperature, pressure and dwell can be achieved. When process speeds approach faster speeds, for example 100 pages per minute (ppm), roll fusing performance is no longer acceptable. As fusing speed increases dwell time must be maintained above a minimum value which means an increase in nip length. Increasing the nip length can be accomplished either by increasing the fuser roll rubber thickness, and/or reducing the modulus and/or increasing the outside diameter of the roll. However, each of these solutions reach their maximum effectiveness at about 100 ppm. Specifically, for an internally heated fuser roll, the fuser roll deformable layer thickness is limited by the maximum temperature the material forming the layers can withstand, and the thermal gradient across the layer. The roll size also becomes a critical issue for reasons of space, weight, cost and substrate stripping therefrom.

In order to obtain much higher fusing speeds than heretofore possible for color, very large or long fusing nips are necessary. One way to achieve longer fusing nips for this purpose is to use a thick deformable belt instead of a fuser roll with a thick deformable layer or layers. Due to poor thermal conductivity, however, it is necessary to heat the outer surface of a thick elastomer belt over an extended contact zone using a source of thermal energy. To create a long nip for extending fusing dwell time, it is desired that the belt be as thick as possible. However, belt flexibility can be compromised with relatively large belt thicknesses. Additional nip length can also be obtained using an elastomeric layer or layers on a pressure roll that contact the internal surface of the thick belt. The thicknesses of the elastomers on the pressure roll and the fuser belt along with other characteristics of the elastomers such as Shore A hardness contribute to the desired characteristics of the fusing nip. The thickness and the durometer of both elastomers can be varied to obtain the desired dwell times in the fusing nip.

Heat transfer to the belt from an external source such as an external heater roll, especially for belts with macro non-uniformities and/or a rough surface can be improved and the belt life extended. External heating of such a belt can be accomplished though the wrapping of a portion of the belt around the external heater roll to create a large wrap therearound and, therefore a large area of contact therebetween. Such contact between the belt and the external heater roll results in a low-pressure contact, in the order of 1 to 3 psi. Because of the poor transfer of heat through the relatively thick belt, no heat is provided from inside of the belt. Low-pressure contact between the belt and pressure roll results in inefficient heat transfer therebetween, particularly, where the belt has macro non-uniformities and/or a rough surface. Poor contact and non-uniform contact result in a cold belt or a belt with cold spots and an unacceptable image gloss and fix level. Additionally, toner fusing and belt contamination are an ongoing problem where the thermal contact is poor and non-uniform which in the worst case results in cold offset. Cold offset is a fusing condition where the toner attaches to the fuser belt surface, which results in both a fuser belt cleaning problem and an image deletion on the paper.

Following is a discussion of references that may bear on the patentability of the present invention. In addition to possibly having some relevance to the question of patentability, these references, together with the detailed description of the present invention to follow, may provide a better understanding of the invention. The references that are discussed herein are hereby incorporated by reference in their entirety.

U.S. patent application Ser. No. 10/217,683 filed on Aug. 12, 2002 and assigned to the same assignee as the present invention discloses a high speed heat and pressure belt fuser apparatus or structure for fixing toner images including an endless belt and a pair of pressure members between which the endless belt is sandwiched for forming a fusing nip through which substrates carrying toner images pass with the toner images contacting an outer surface of the endless belt. Thus, one of the pressure rolls is supported internally of the endless belt while the other pressure roll is supported externally of the belt. The belt has at least one conformable or deformable layer which cooperates with a deformable or conformable layer on at least one of the pressure members to provide a large nip that yields high gloss images, long belt life, minimal edge wear and reliable stripping at high speeds.

Effective substrate stripping is accomplished by wrapping a portion of the belt about the external roll in a post-nip area.

U.S. patent application Ser. No. 10/093,263 filed on Mar. 8, 2002 assigned to the same assignee as the present invention discloses a heat and pressure belt fuser structure having an endless belt and a pair of pressure engageable members between which the endless belt is sandwiched for forming a fusing nip through which substrates carrying toner images pass with the toner images contacting an outer surface of the endless belt, at least one of the pressure engageable members has one or more deformable layers, and the endless belt has a thickness of from about 1 to about 8 mm; and the fuser structure includes an external source of thermal energy for elevating a pre-nip area of the belt. The thick belts in combination with a deformable layer of at least one of the pressure member(s) cooperate to provide a large nip and adequate creep for intrinsic paper stripping. A creep value less than a predetermined value prevents stripping.

U.S. Pat. No. 5,890,047 granted to Rabin Moser on Mar. 30, 1999 discloses a combination belt and roll fuser has a pair of pressure engageable rolls with a belt looped or wrapped around one of the pressure engageable rolls such that the belt is sandwiched between the two rolls. The belt is deformed due to the force exerted by the pressure rolls such that it forms a single fusing nip. Substrates carrying toner images pass through the single fusing nip with the toner images contacting the outer surface of the belt. An internally heated, thermally conductive roll contacts a portion of the belt externally at a pre-nip location for elevating its temperature of the belt. The pressure engageable roll about which the belt is entrained is internally heated during warm-up for minimizing a phenomenon known as droop. This belt and roll fuser configuration exhibits the characteristics of a Nip Forming Fuser Roll (NFFR) fuser as discussed above.

U.S. Pat. No. 6,246,858 discloses an electrostatographic reproduction machine that includes a fuser belt moving or position changing mechanism for moving the fuser belt and controllably changing its position axially relative to a plurality of rollers supporting the belt for movement in an endless path. The belt moving mechanism is suitable for controllably moving the endless fusing belt axially, (relative to the plurality of rollers) from a first fusing position to at least a second fusing position so as to reduce sheet edge wear in the same spot on the external fusing surface of the endless fusing belt.

U.S. Pat. No. 5,983,048 a temperature droop compensated NFFR fuser having a preheater structure which conveys the substrate carrying toner images past a radiant heat contained therein and then into the nip of a pair of pressure engaged fuser rollers that form the NFFR fuser. One of the fuser rollers is heated by an internal heater that is supplied a constant level of power that generally maintains the temperature of the heated roller to a temperature sufficient to fuse the toner images on the substrate. The preheater structure warms the substrate carrying toner images prior to entry into the nip of the fuser rollers to compensate for the temporary temperature droop of the fuser rollers that is encountered when the fuser moves from a standby mode to an operating mode. The combination of pre-warmed substrate and the temperature to which the heated fuser roller droops is sufficient to completely fuse the toner images on the substrate. With time in the operating mode, the fuser rollers recover from droop and the radiant heat source in the preheater structure is turned off.

U.S. Pat. No. 5,729,812 granted Mar. 17, 1998 relates to a combination dual hard roll and dual elastomeric belt fuser. A pair of hard, heated fuser rolls having elastomeric belts entrained thereabout are supported such that segments of the belts are sandwiched in a nip area therebetween. The belt segments are sufficiently thick to provide belt conformability resulting in high quality fused images. One of the belts is partially wrapped about one of the rigid rolls to form an extended heating zone and a combination heat and pressure zone through which substrates carrying toner images are moved.

U.S. Pat. No. 4,242,566 granted to Albert W. Scribner on Dec. 30, 1980 discloses a heat and pressure fusing apparatus that exhibits high thermal efficiency. The fusing apparatus comprises at least one pair of first and second oppositely driven pressure fixing feed rollers, each of the rollers having an outer layer of a thermal insulating material; first and second idler rollers, a first flexible endless belt disposed about the first idler roller and each of the first pressure feed rollers and a second flexible endless belt disposed about the second idler roller and each of the second pressure feed rollers, at least one of the belts having an outer surface formed of a thermal conductive material, wherein there is defined an area of contact between the outer surfaces of the first and second belts located between the first and second pressure feed rollers for passing the copy sheet between the two belts under pressure; and means spaced relative to the belt whose outer surface comprises the thermal conductive material for heating the outer surface thereof, whereby when an unfused copy sheet is passed through the area of contact between the two belts it is subject to sufficient heat and pressure to fuse developed toner images thereon.

U.S. Pat. No. 4,582,416 granted to Karz et al on Apr. 15, 1986 discloses a heat and pressure fusing apparatus for fixing toner images. The fusing apparatus is characterized by the separation of the heat and pressure functions such that the heat and pressure are effected at different locations on a thin flexible belt forming the toner-contacting surface. A pressure roll cooperates with a stationary mandrel to form a nip through which the belt and copy substrates pass simultaneously. The belt is heated such that by the time it passes through the nip its temperature together with the applied pressure is sufficient for fusing the toner images passing through.

U.S. Pat. No. 4,992,304 granted to Gilbert et al on May 1, 1990 discloses a fuser belt for a reproduction machine. The belt may have one of several configurations which all include ridges and interstices on the outer surface which contacts the print media. These interstices are formed between regularly spaced ridges, between randomly spaced particles, between knit threads. These interstices allow the free escape of steam from the media during high-temperature fusing of the reproduction process. As the steam escapes freely, the steam does not accumulate in the media causing media deformations and copy quality deterioration. Additionally, media handling is improved because the ridges and interstices reduce the unwanted but unavoidable introduction of thermal energy into the copy media.

U.S. Pat. No. 5,250,998 granted to Ueda et al on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,349,424 granted to Dalal et al on Sep. 20, 1994 discloses a heated, thick-walled, belt fuser for an electrophotographic printing machine. The belt is rotatably supported between a pair of rolls. One of the spans of the belt is in contact with a heating roll in the form of an aluminum roll with an internal heat source such as a quartz lamp. The belt is able to wrap a relatively large portion of the heating roll to increase the efficiency of the hat transfer. The second span of the belt forms an extended fusing nip with a pressure roll. The extended nip provides a greater dwell time for a sheet in the nip while allowing the fuser to operate at a greater speed. External heating enables a thick profile of the belt, which in turn allows the belt to be reinforced so as to operate at greater fusing pressures without degradation of the image. The thick profile and external heating of the belt also provides a much more robust design than conventional thin walled belt fusing systems.

U.S. Pat. No. 5,465,146 granted to Hgashi et al on Nov. 7, 1995 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a heating roller, a pressing roller is arranged to press the surface of the elastic fixing roller upwardly from the lower side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per $cm^2$ within the range of 0.001 to 0.02 cal/° C.

SUMMARY

The present invention provides a high speed heat and pressure belt and roll fuser structure comprising: a plurality of members including a deformable (i.e. conformable) endless belt and a pair of pressure rolls between which the endless belt is sandwiched for forming a fusing nip through which substrates carrying toner images pass with the toner images contacting an outer surface of the endless belt. Thus, one of the pressure members is positioned internally of the endless belt while the other one is positioned externally thereof. The internal pressure member comprises at least one deformable (i.e. conformable) layer and the belt comprises at least one deformable (i.e. conformable) outer layer.

An external source of thermal energy is provided for elevating a pre-nip area of the belt.

The present invention provides efficient uniform heat transfer to a fusing belt, especially belts with macro non-uniformities and/or a rough surface, for enabling more uniform fusing and extending belt life.

The addition of a spring-loaded mechanism inside a belt module at the point of contact with an External Heat Roll (EHR) produces superior contact between the external heater roll and the fusing belt, thus, better heat transfer to the belt. A positive and consistent contact during the heating wrap is essential for uniform and high image gloss.

DESCRIPTION OF THE INVENTION

Figure 1:
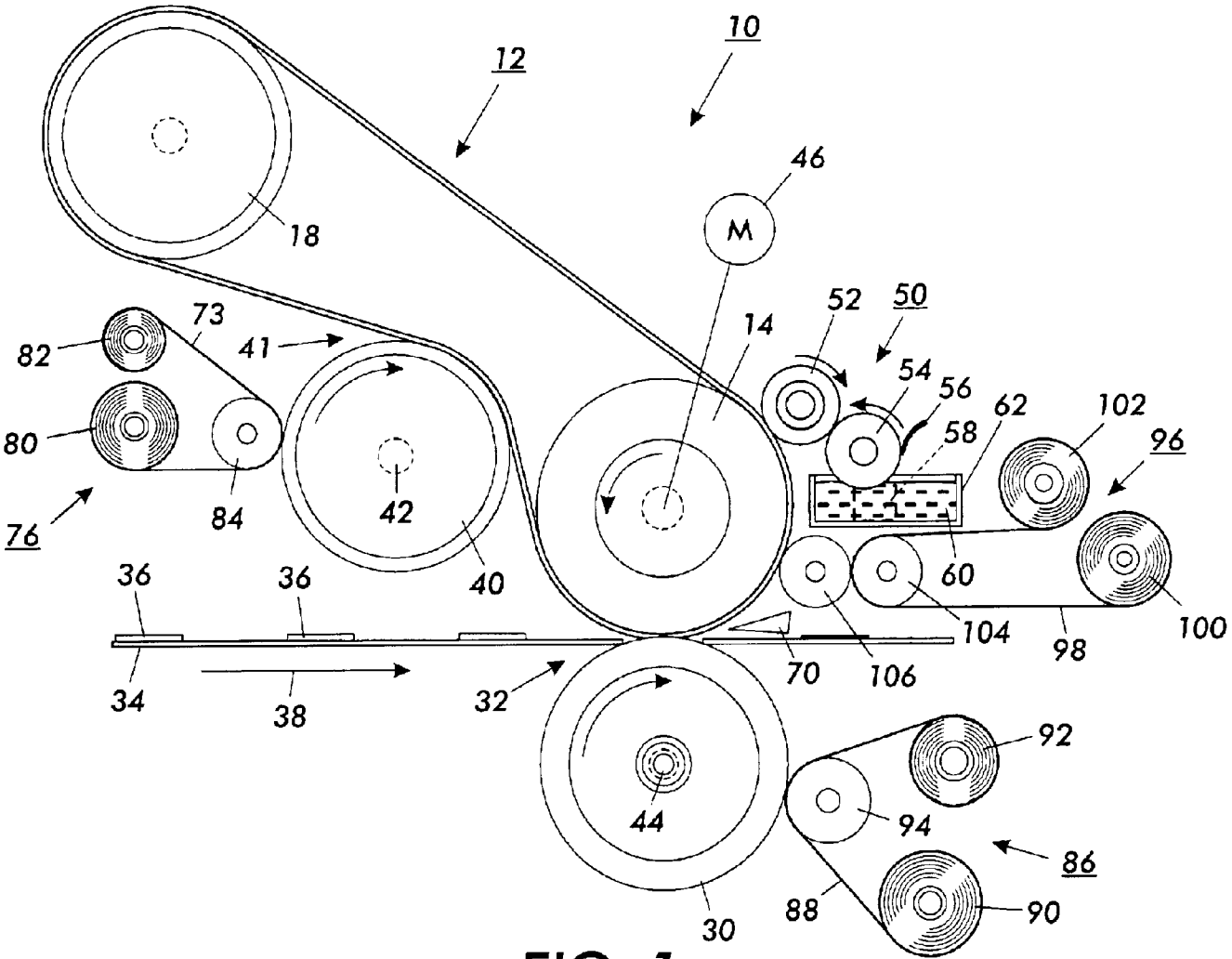
FIG. 1 is a schematic representation of a prior art heat and pressure belt fuser.

There is provided a high-speed heat and pressure belt fuser including a pair of pressure rolls and an externally heated, relatively thick elastomeric fusing belt. The pressure engageable rolls and belt are supported such that the belt is sandwiched between the two pressure rolls. The belt is supported by a plurality of rolls one of which is one of the pressure rolls. The belt and the pressure engageable roll about which the belt is looped are each provided with one or more deformable layers which cooperate to form a single elongated nip through which substrates carrying toner images pass with the toner images contacting the outer surface of the elastomeric belt. An external source of heat is provided for contacting the outer surface of the belt in a pre-nip area.

The external heating allows for maximum elastomer temperatures to be attained at the fusing surface without relying on heat transfer through the belt. Externally heating the belt enables larger belt thicknesses allowing for increased nip widths necessary for higher process speeds without image gloss degradation while exhibiting long life and minimal edge wear. Higher fusing surface temperatures also enable the use of high melting temperature toners as well as the use of large toner pile heights. Therefore, the belt can be used for fusing color toner images as well as black toner images.

Although increasing elastomer thickness would normally be expected to result in fuser "droop," the present invention allows for a reduction in the "droop" of the fuser to little or no droop. Droop is defined as the reduction in Fuser Roll (FR) surface temperature over time as a function of contact with ambient media and/or a cooler Pressure Roll (PR). With internally heated roll fusers, especially rolls with thick rubber layers, the droop can be significant because of the time it takes to heat through the bulk of the rubber after the paper and pressure roll (PR) start drawing heat from the FR. The effects of droop lead to poor image fix and gloss within a series of prints. The external heating of the belt replenishes the heat quickly at the belt surface prior to the belt re-entering the fusing nip, thereby eliminating the time lag caused by heating through the rubber, in the case of a roll fuser.

The belt also has the potential of being more environmentally friendly since only the rubber needs to be replaced when the fusing surface of the belt reaches its useful life.

In the description of the Figures to follow, the same reference characters are used to refer elements that are the same in each Figure.

For a general understanding of the features of the present invention, reference is made to the drawings, in which, like reference numerals have been used throughout to identify identical elements.

As disclosed in FIG. 1, a belt fuser of the prior art comprises a high-speed heat and pressure belt fuser indicated generally by the reference character 10. An elastomeric belt structure 12 is supported for movement in an endless path by a pair of support rolls 14 and 18. By way of example, the belt structure 12 is a three-layered arrangement comprising a base layer, a middle layer and an outer layer. The base or substrate layer is fabricated in a well-known manner from a suitable fabric utilized for this purpose. The substrate can be a polyimide such as a polyamide imide woven fabric such as NOMEX®, available from DuPont. The base layer constitutes the inner surface of the belt structure 12. The middle layer is a conformable layer of, for example, silicone rubber having a thickness in the order of 3 to 4.5 mm. The outer layer, which constitutes the outer surface of the belt structure 12, also by way of example, is a conformable material such as Viton™ 1198 having a thickness of about 40 $\mu$m. The outer layer may also comprise a solid silicone material such as polydimethylsiloxane. As an example, the belt structure 12 may have a width of 410 mm and an overall length of 725 mm.

Roll 14 is an Internal Pressure Roll (IPR), in that it is supported for contact with the inner surface of the base layer of the elastomeric belt 12. The IPR 14 which, by way of example, has an outside diameter of 94 mm, is provided with a comformable outer layer that has preferably a thickness of about 8 mm and has a Shore A value of 60.

Roll 18 provides suitable tensioning of the elastomeric belt and is gimbaled in a well-known manner, not shown, for effecting proper steering thereof.

A second pressure roll 30 is supported such that the elastomeric belt 12 is sandwiched between it and the IPR 14 in order to form an elongated, fusing nip 32. Thus, the roll 30 constitutes an External Pressure Roll (EPR). The conformable layers of the belt structure 12 and the IPR 14 cooperate to form the nip 32. In order to obtain the desired high speed fusing, a large nip length is required which still has adequate creep to enable paper stripping. Creep is defined as the velocity ratio of the fuser belt surface in the fusing nip compared to its speed outside the nip.

Imaged substrates such as a sheet of plain or coated paper 34 carrying toner images 36 moving in the direction of arrow 38 pass through the nip 32 with the toner images contacting an outer surface of the outer surface of the belt structure 12.

The fusing nip 32 comprises a single nip in that the section of belt contacted by the IPR roll 14 is coextensive with the opposite section of the belt contacted by roll 30. In other words, neither of the rolls 14 and 30 contact a section of the belt not contacted by the other of these two rolls. A single nip insures a single nip velocity and high pressure through the entire nip.

The outer surface of the elastomeric belt structure 12 is elevated to fusing temperature by means of an internally heated roll 40 having a conventional quartz heater lamp 42 disposed internally thereof. The roll 40 which by way of example has a diameter of 87 mm comprises a relatively thin (0.050 to 0.5 inch) walled metal structure chosen for its good thermal transfer properties. To this end, the roll 40 may be fabricated from metal such as aluminum, stainless steel, or the like and can either be anodized and/or overcoated with a thin (about 1 to about 4 mils) conductive perfluoroalkoxy (PFA). The roll 40, as shown in FIG. 1, contacts the outer surface of the belt structure in a pre-nip area 41.

The IPR 14 is not provided with an internal heat source, because it is not practical to do so. However, another quartz heating element 44 may be disposed internally of the EPR 30 for providing thermal energy during fuser warm-up and/or on an as needed basis. By supplying heat to roll 30 during extended runs with heavy paper, the phenomenon commonly referred to as droop is decreased or eliminated.

A motor 46 operatively connected to the IPR roll 14 through a conventional drive mechanism (not shown) provides for rotation of the roll 14. The frictional interface between the elastomeric belt 12 and the roll 14 imparts movement to the belt structure 12 and the friction developed between the belt structure 12 and the rolls 14 and 18 causes those rolls to be driven by the belt. Separate drive mechanisms (not shown) may be provided where necessary for imparting motion to any or all of the rolls.

For the purpose of preventing toner offset to the heated belt structure 12 there is provided an optional Release Agent Management (RAM) system generally indicated by reference character 50. The mechanism 50 may be of numerous configurations well known in the art and may comprise a donor roll 52, metering roll 54, metering blade 56 and a wick 58. The metering roll 54 is partially immersed in release agent material 60 and is supported for rotation such that it is contacted by the donor roll 52 which is supported so as to contact the fusing belt structure 12. The release agent material is, by way of example, can be either functional or non-functional silicone oil. As can be seen, the orientation of the rolls 52 and 54 is such as to provide a path for conveying material 60 from a sump 62 to the surface of the belt. In order to permit rotation of the metering roll 54 at a practical input torque to the belt structure 12, the donor roll 52 may comprise an outer deformable or conformable layer, which forms a first nip between the metering roll and the donor roll and a second nip between the latter and the belt. The nips also permit satisfactory release agent transfer between the rolls and the belt.

Wick 58 is fully immersed in the release agent and contacts the surface of the metering roll 54. The purpose of the wick is to provide an air seal that disturbs the air layer formed at the surface of the metering roll 54 during rotation thereof. If it were not for the function of the wick, the air layer would be coextensive with the surface of the roll immersed in the release agent thereby precluding contact between the metering roll and the release agent.

The blade 56 functions to meter the release agent picked up by the roll 54 to a predetermined thickness, such thickness being of such a magnitude as to result in several microliters of release agent consumption per copy. The deformable layer of the donor roll may comprise silicone rubber. However, other materials may also be employed.

A thin sleeve on the order of several mils constitutes the outermost surface of the roll 52. The sleeve material comprises TEFLON®, VITON®, or any other material that will impede penetration of silicone oil into the silicone rubber. While the donor roll may be employed without the sleeve, it has been found that when the sleeve is used, the integrity of the donor roll is retained over a longer period and contaminants such as lint on the belt will not readily transfer to the metering roll 54. Accordingly, the material in the sump will not become contaminated by such contaminants.

The thicknesses of the elastomers on both the internal pressure roll (IPR) 14 and the fuser belt structure 12 as well as the durometer thereof contribute to the characteristics of the fusing nip. The thickness and the durometer of both elastomers can be varied to obtain the desired dwell times in the fusing nip.

The fusing nip length is strongly dependent on the IPR rubber thickness. Maximum creep is obtained with no rubber on the IPR and all the rubber on the belt. A very large nip width is obtained by making the IPR rubber very thick but this results in very low creep and makes paper stripping difficult without some modification of the fuser structure 10.

The length of the fusing nip also depends on the pressure exerted in the nip but for a nominal pressure of 100+/−15 psi. the change in nip width is small.

The internal pressure roller 14 may comprise a metal roller, or may have an outer elastomeric layer thereon. Examples of suitable elastomers for the internal pressure roller layer include silicone rubbers, fluoroelastomers such as VITON®, and the like. The thickness of the internal pressure roll elastomer layer is from about 1 to about 25 mm, or from about 5 to about 10 mm. The durometer of the elastomer layer is from about 30 to about 80, or from about 45 to about 70 Shore A.

The external pressure roller 30 may be a metal roller, and may comprise an outer layer thereon. Such an optional outer layer may be anodized aluminum or be comprised of a plastic material such as a fluoropolymer, for example, TEFLON®, or the like plastics where high thermal conductivity is preferred. The outer layer of the external pressure roller may have a thickness of from about 1 to about 4 mils, or from about 2 to about 3 mils.

While the belt fuser apparatus disclosed tends to be self-stripping a stripping aid 70 is provided to insure reliable stripping. To this end, the aid 70 may comprise an air knife or other suitable auxiliary device.

A plurality of toner removal or cleaning devices 76, 86 and 96 are provided for preventing toner particles and other contaminants from being deposited on an imaged substrate. Toner removal or cleaning device 76 is provided for removing toner and other materials from the External Heat Roll 40. The device 76 comprises a cleaning web 73 supported by supply and take-up rolls 80 and 82. A pressure roll 84 is provided for holding the web 73 in pressure contact with the EHR 40.

Toner removal or cleaning device 86 is provided for removing toner and other materials from the External Pressure Roll 30. The cleaning device 86 comprises a cleaning web 88 supported by supply and take-up rolls 90 and 92. A pressure roll 94 is provided for holding the web 88 in pressure contact with the EPR 30.

For removing toner particles and other contaminants from the outer surface of the belt structure 12, there is provided a device 96. The toner removal or cleaning device 96 comprises a cleaning web 98, supply and take-up rolls 100, 102 and a pressure roll 104. The pressure roll 104 serves to hold the web 98 in pressure engagement with a cleaner roll 106 that contacts the outer surface of the belt structure 12. As will be appreciated the cleaner roll 106 removes the toner particles and other contaminants from the belt structure. These materials are then transferred from the cleaner roll 106 to the cleaning web 98. The cleaner roll 106 may be provided with an outer layer of well know material that facilitates removal of the toner and contaminants from the belt structure.

Figure 2:
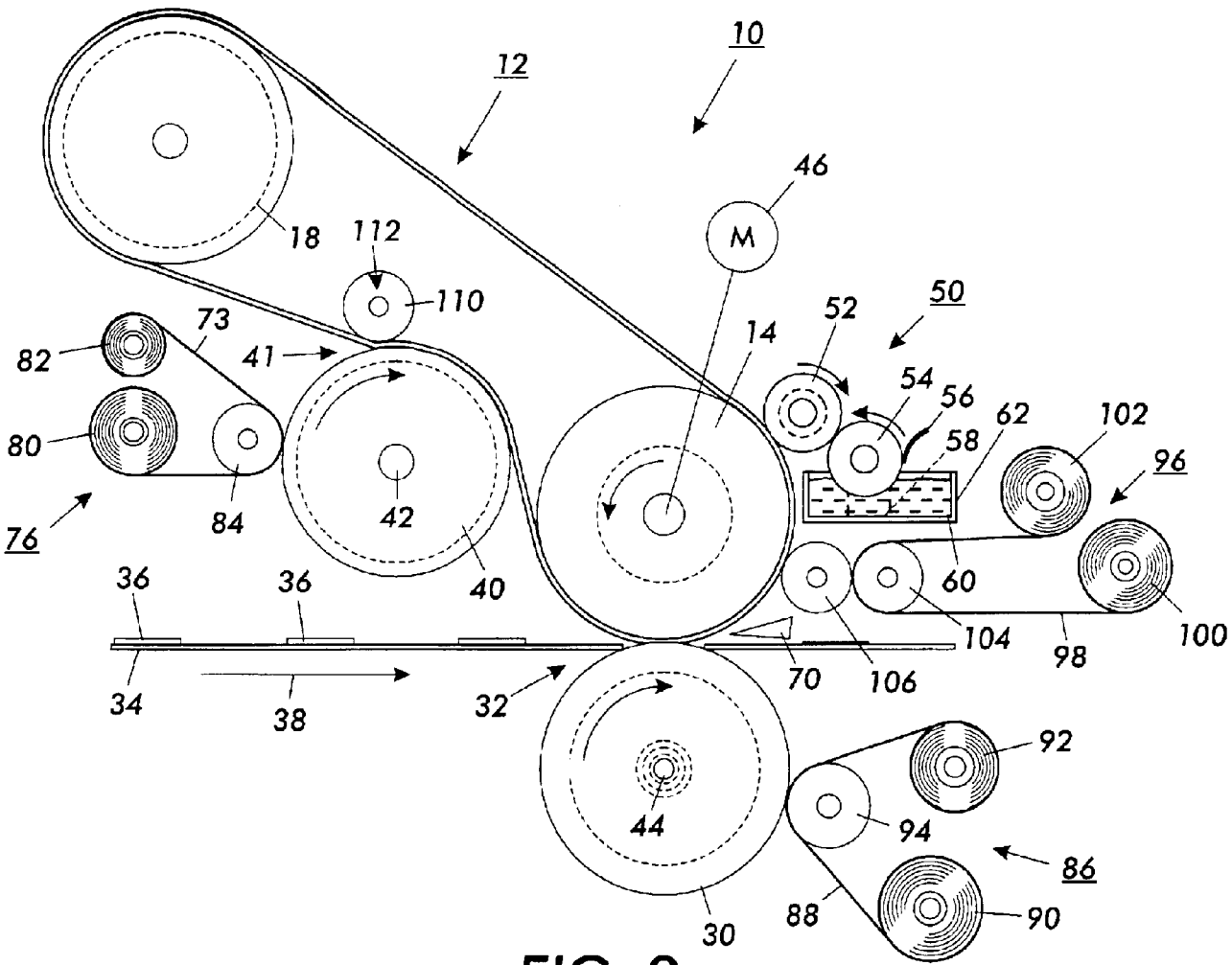
FIG. 2 is a schematic representation of a high-speed heat and pressure belt fuser of the present invention.

As shown in FIG. 2, a spring loaded pressure roll 110 contacts the inner surface of the belt structure 12. The pressure roll 110 contacts the belt structure at the point of initial belt contact with the External Heat Roll. The pressure roll effects positive and consistent contact between the belt and the surface of the External Heat Roll at the beginning of the wrap of the belt about the EHR. Such intimate contact provides efficient heat transfer from the EHR 40 and the fuser belt that is essential for uniform and high image gloss. The pressure in this initiating contact is produced by the pressure roll 110 is high enough to iron out any defects in the belt surface. Pressure in the range of 2 to 100 psi and preferably in the range of 20 to 40 psi. is exerted on the pressure roll 110. This pressure is applied using a suitable mechanism (not shown) applied to a shaft of the of the pressure roll in the direction of the arrow 112 and generally in the direction of the axial center of the EHR 40.

Figure 3:
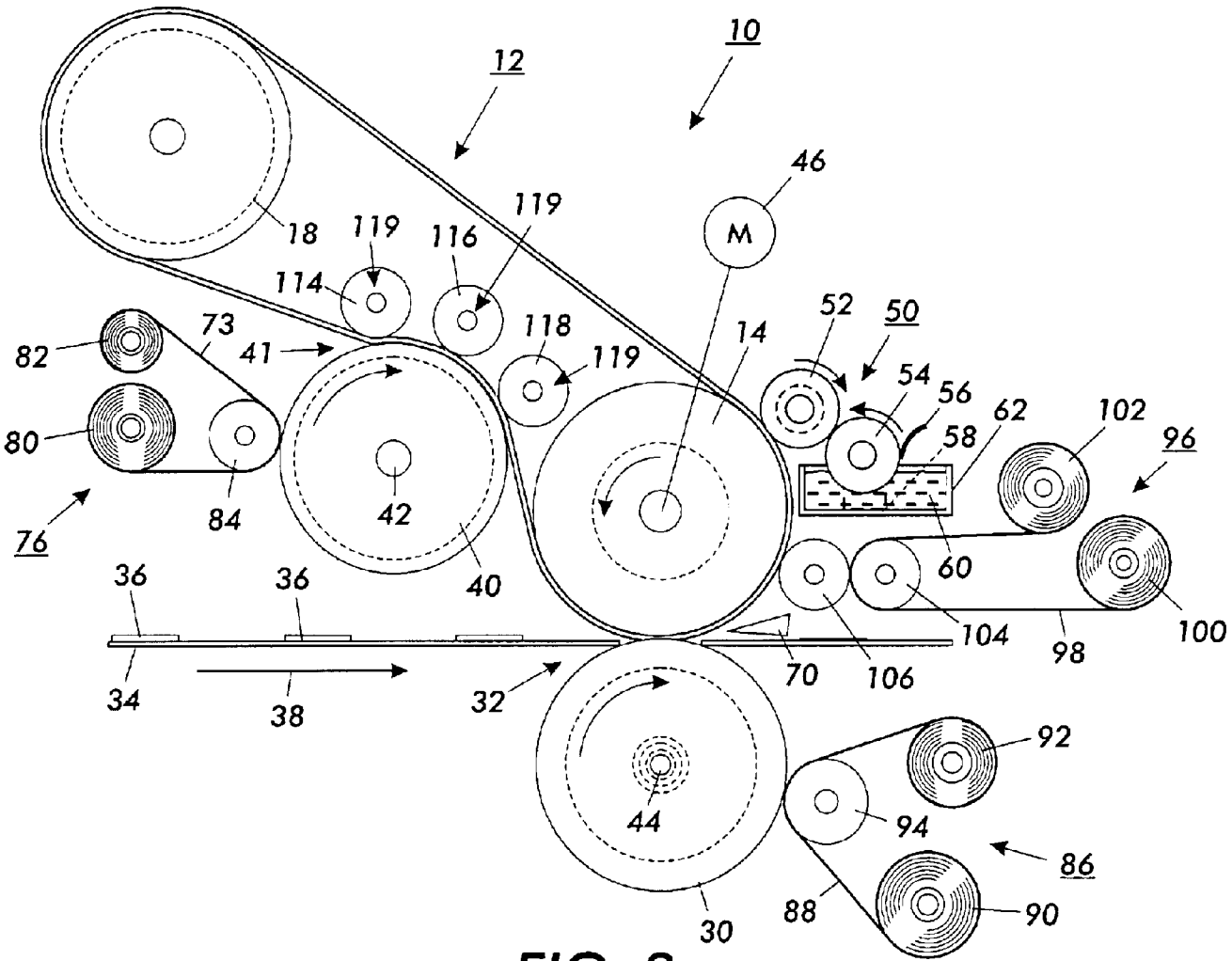
FIG. 3 is another embodiment of the high-speed heat and pressure fuser illustrated in FIG. 2.

As shown in FIG. 3, a plurality of spring loaded pressure rolls 114, 116 and 118 are provided for effecting intimate contact between the fusing belt structure 12 and the External Heat Roll 40. The pressure roll 114 contacts the belt structure at the point of initial belt contact with the External Heat Roll. The pressure rolls 116 and 118 contact the belt at the middle and end areas of contact between the fuser belt structure 12 and the EHR 40. Loading in the order of 20 to 40 psi. is effected individually to the through the shafts of the rolls 114, 116 and 118 as indicated by arrows 119. The loading is effected using a roll loading mechanism (not shown) and must be applied in a direction towards the axial center of the EHR.

Figure 4:
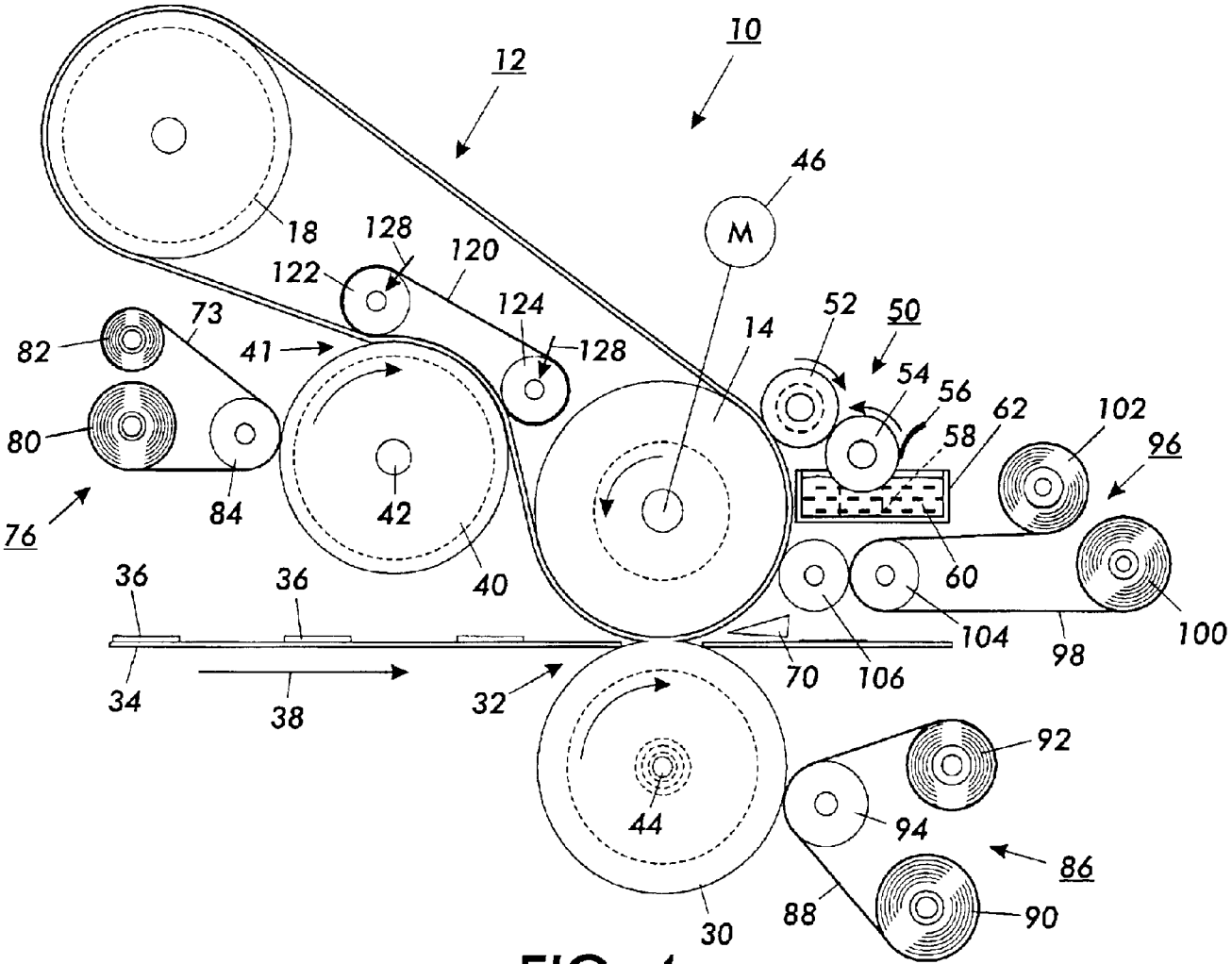
FIG. 4 is yet another modified embodiment of the high-speed heat and pressure fuser illustrated in FIG. 2.

In another embodiment of the in invention as disclosed in FIG. 4, intimate contact between the belt structure 12 and the EHR 40 is effected using a pressure belt structure 120. The belt structure is operatively supported by a pair of rolls 122 and 124, the former being positioned at the point of initial belt contact with the External Heat Roll 40 while the support roll 124 is positioned at the end area of contact. The portion of the pressure belt structure 120 contacting the EHR 40 serves the same function of the roll 116 of the embodiment of FIG. 3. The belt structure 120 comprises a high-tension steel pressure belt. The loading of the belt is effected by applying pressure to the shafts of the support rolls 122 and 124 using a load applying mechanism (not shown) for applying a load in a direction depicted by arrows 128 towards and approximately tangential to the surface of the EHR 40 to simultaneously tension the pressure belt 120 and thereby create a high pressure contact between the fuser belt and the EHR in the heat transfer contact region 41. The load effected using the belt structure 120 is in the range of 2 to 100 psi and preferably in the range of 20 to 40 psi.

Figure 5:
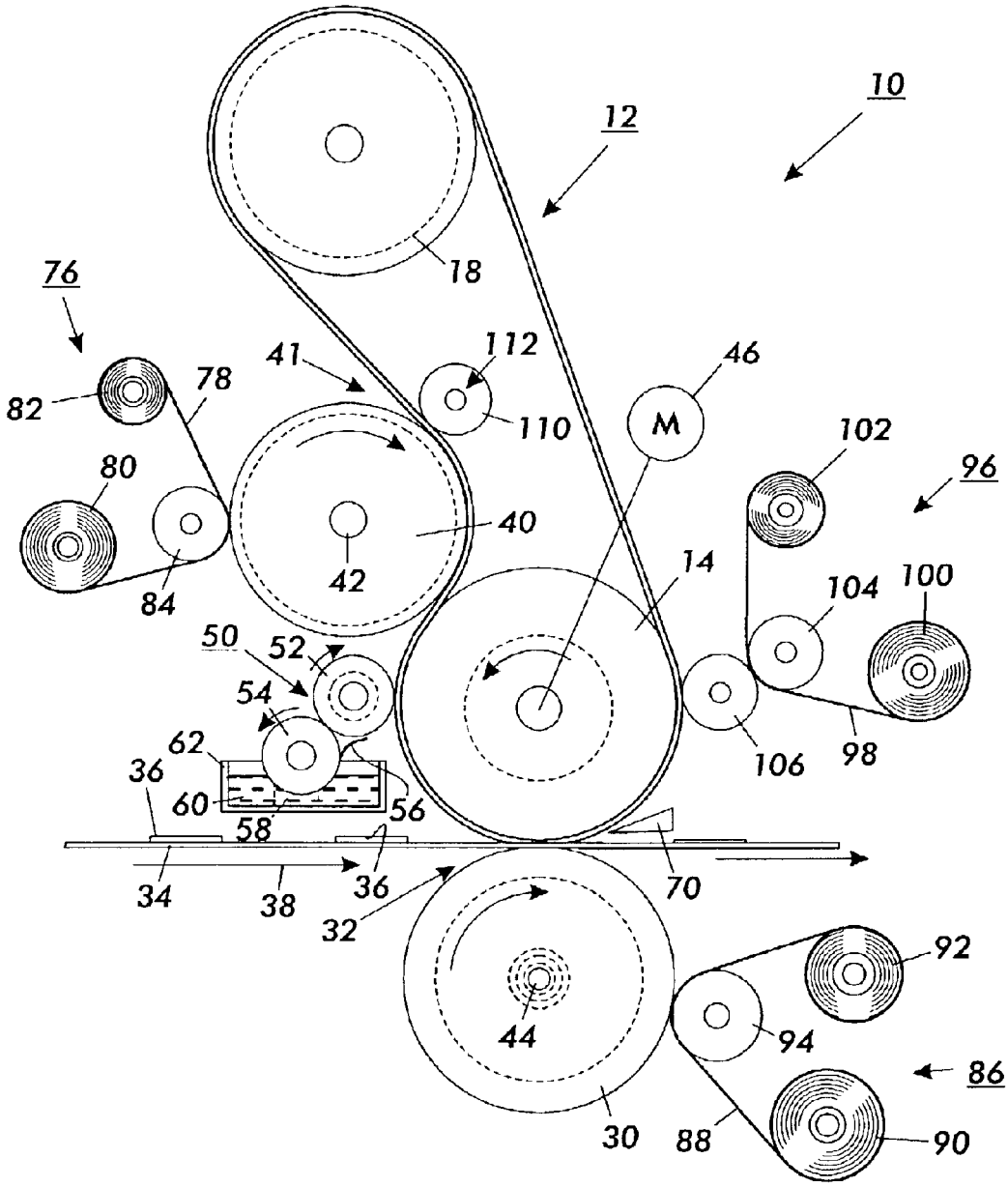
FIG. 5 is still another embodiment of the high-speed heat and pressure fuser illustrated in FIG. 2.

The embodiment disclosed in FIG. 5 utilizes the same technique for effecting intimate contact between the belt structure 12 and the EHR 40 shown in FIG. 2. To this end, a single pressure roll 110 is employed with an applied force whose direction is indicated by arrow 112, which generally points towards the axial center of the EHR 40. It will be appreciated that the pressure devices of FIGS. 3 and 4 may also be utilized in the embodiment of FIG. 5. The embodiment of FIG. 5 illustrates a modified fuser architecture with a different location of the oiling system to the post heater area and a modified arrangement and location for the cleaning systems 76 and 96 for removing toner and contaminants from the External Heat Roll 40 and the belt structure 12.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. A high-speed heat and pressure belt fuser structure, said belt fuser structure comprising:

an endless belt comprising at least one conformable layer;

a plurality of rolls positioned internally of said belt for supporting movement of said belt in an endless path, one of said rolls comprising an internal pressure roll contacting an inner surface of said belt;

an external pressure roll supported for contact with an outer surface of said belt such that said belt is sandwiched between said internal and external pressure rolls, one of said pressure rolls including at least one conformable layer;

a heated roll forming an external source of thermal energy for elevating the surface temperature in a pre-nip area of said belt;

pressure means for effecting pressure engagement of said rolls whereby an elongated nip is formed through which imaged substrates pass with toner images carried thereby contacting said outer surface of said belt;

pressure exerting means for effecting intimate contact between said external source of thermal energy at least as its initial point of contact with said endless belt, said pressure exerting means cooperating with said internal pressure roll for effecting partial wrapping of said endless about said heated roll.

2. A high-speed heat and pressure belt fuser structure according to claim 1 wherein said pressure exerting means for effecting intimate contact comprises at least one pressure roll.

3. A high-speed heat and pressure belt fuser structure according to claim 2 including additional pressure rolls for effecting intimate contact between said external source of thermal energy beyond said initial point of contact with said source of external thermal energy.

4. A high-speed heat and pressure belt fuser structure according to claim 3 wherein said at least one pressure roll and said additional pressure rolls effect a pressure of between 20 to 40 pounds per square inch between said belt and said external source of thermal energy.

5. A high-speed heat and pressure belt fuser structure according to claim 2 wherein said at least one pressure roll exerts between 20 to 40 pounds per square inch.

6. A high-speed heat and pressure belt fuser structure according to claim 1 wherein said pressure exerting means for effecting intimate contact comprises a pressure belt.

7. A high-speed heat and pressure belt fuser structure according to claim 6 wherein said pressure exerting means for effecting intimate contact comprises a pair of pressure rolls supporting said pressure belt.

8. A high-speed heat and pressure belt fuser structure according to claim 7 wherein said pressure exerting means for effecting intimate contact results in a pressure of between 20 to 40 pounds per square inch between said belt and said external source of thermal energy.

9. A high-speed heat and pressure belt fuser structure according to claim 6 wherein said pressure belt effects a pressure of between 20 to 40 pounds per square inch between said endless belt and said external source of thermal energy.

10. A high-speed heat and pressure belt fuser structure, said belt fuser structure comprising:

an endless belt comprising at least one conformable layer;

a plurality of rolls positioned internally of said belt for supporting movement of said belt in an endless path;

a heated roll forming an external source of thermal energy for elevating the surface temperature in a pre-nip area of said belt;

pressure exerting means for effecting intimate contact between said external source of thermal energy at least at its initial point of contact with said endless belt, said pressure exerting means cooperating with one of said plurality of rolls positioned internally of endless belt for effecting partial wrapping of said endless belt around said heated roll.

11. A high-speed heat and pressure belt fuser structure according to claim 10 wherein said pressure exerting means for effecting intimate contact comprises at least one pressure roll.

12. A high-speed heat and pressure belt fuser structure according to claim 11 including additional pressure rolls for effecting intimate contact between said external source of thermal energy beyond said initial point of contact with said source of external thermal energy.

13. A high-speed heat and pressure belt fuser structure according to claim 12 wherein said at least one pressure roll and said additional pressure rolls exert a pressure between 20 to 40 pounds per square inch.

14. A high-speed heat and pressure belt fuser structure according to claim 11 wherein said at least one pressure roll exerts between 20 to 40 pounds per square inch.

15. A high-speed heat and pressure belt fuser structure according to claim 10 wherein said pressure exerting means for effecting intimate contact comprises a pressure belt.

16. A high-speed heat and pressure belt fuser structure according to claim 15 wherein said pressure exerting means for effecting intimate contact comprises a pair of pressure rolls supporting said pressure belt.

17. A high-speed heat and pressure belt fuser structure according to claim 16 wherein said pressure belt and supporting rolls exert between 20 to 40 psi.

18. A high-speed heat and pressure belt fuser structure according to claim 15 wherein said pressure belt exerts a pressure between 20 to 40 pounds per square inch.

19. A high-speed heat and pressure belt fuser structure according to claim 10 wherein said pressure exerting means for effecting intimate contact effects between 20 to 40 pounds per square inch.

* * * * *